US010942475B2

(12) United States Patent
Fujimoto et al.

(10) Patent No.: US 10,942,475 B2
(45) Date of Patent: Mar. 9, 2021

(54) FIXING DEVICE AND IMAGE FORMING APPARATUS INCLUDING NIP FORMER OF SPECIFIC SURFACE ROUGHNESS

(71) Applicants: Ippei Fujimoto, Kanagawa (JP); Yoshiki Yamaguchi, Kanagawa (JP); Takashi Seto, Kanagawa (JP); Hiroyuki Shimada, Tokyo (JP)

(72) Inventors: Ippei Fujimoto, Kanagawa (JP); Yoshiki Yamaguchi, Kanagawa (JP); Takashi Seto, Kanagawa (JP); Hiroyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/860,221

(22) Filed: Apr. 28, 2020

(65) Prior Publication Data

US 2020/0409292 A1 Dec. 31, 2020

(30) Foreign Application Priority Data

Jun. 27, 2019 (JP) ..... JP2019-119443

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2025; G03G 15/2053
See application file for complete search history.

(56) References Cited

U.S. PATENT DOCUMENTS

| | | | |
|---|---|---|---|
| 2017/0102652 | A1 | 4/2017 | Imada et al. |
| 2018/0017910 | A1 | 1/2018 | Sawada et al. |
| 2018/0173138 | A1 | 6/2018 | Seki et al. |
| 2019/0286025 | A1 | 9/2019 | Yamaguchi et al. |
| 2020/0033777 | A1 | 1/2020 | Fujimoto et al. |

FOREIGN PATENT DOCUMENTS

| | | |
|---|---|---|
| JP | 2012-168484 | 9/2012 |
| JP | 2013-210608 | 10/2013 |
| JP | 2019-159251 | 9/2019 |

*Primary Examiner* — Arlene Heredia

(74) *Attorney, Agent, or Firm* — Harness, Dickey & Pierce, P.L.C.

(57) ABSTRACT

A fixing device includes a fixing rotator that rotates and includes an inner face. A pressure rotator is disposed opposite the fixing rotator and rotates. A nip former sandwiches the fixing rotator together with the pressure rotator to form a nip between the fixing rotator and the pressure rotator. The nip former includes an outer face disposed opposite the inner face of the fixing rotator. The inner face of the fixing rotator and the outer face of the nip former sandwich a lubricant. At least one of the inner face of the fixing rotator and the outer face of the nip former includes a projection having a volume smaller than 0.3 ml/m$^2$ and a recess having a spatial volume greater than 0.08 ml/m$^2$. The volume and the spatial volume are three-dimensional surface roughness parameters, respectively, defined by the International Organization for Standardization 25178 standard in an initial state before the fixing rotator rotates.

10 Claims, 4 Drawing Sheets

FIXING DEVICE AND IMAGE FORMING APPARATUS INCLUDING NIP FORMER OF SPECIFIC SURFACE ROUGHNESS

CROSS-REFERENCE TO RELATED APPLICATION

This patent application is based on and claims priority pursuant to 35 U.S.C. § 119(a) to Japanese Patent Application No. 2019-119443, filed on Jun. 27, 2019, in the Japan Patent Office, the entire disclosure of which is hereby incorporated by reference herein.

BACKGROUND

Technical Field

Exemplary aspects of the present disclosure relate to a fixing device and an image forming apparatus.

Discussion of the Background Art Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ a fixing device including a fixing rotator (e.g., a fixing belt) that is endless and tubular, a pressure rotator (e.g., a pressure roller), and a nip former. The pressure rotator presses against the nip former via the fixing rotator to form a fixing nip between the fixing rotator and the pressure rotator. As a recording medium bearing a toner image is conveyed through the fixing nip, the fixing rotator and the pressure rotator fix the toner image on the recording medium under heat and pressure.

SUMMARY

This specification describes below an improved fixing device. In one embodiment, the fixing device includes a fixing rotator that is tubular and rotates. The fixing rotator includes an inner face. A pressure rotator is disposed opposite the fixing rotator and rotates. A nip former sandwiches the fixing rotator together with the pressure rotator to form a nip between the fixing rotator and the pressure rotator. The nip former includes an outer face disposed opposite the inner face of the fixing rotator. The inner face of the fixing rotator and the outer face of the nip former sandwich a lubricant. At least one of the inner face of the fixing rotator and the outer face of the nip former includes a projection having a volume smaller than 0.3 ml/m$^2$ and a recess having a spatial volume greater than 0.08 ml/m$^2$. The volume and the spatial volume are three-dimensional surface roughness parameters, respectively, defined by the International Organization for Standardization 25178 standard in an initial state before the fixing rotator rotates.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
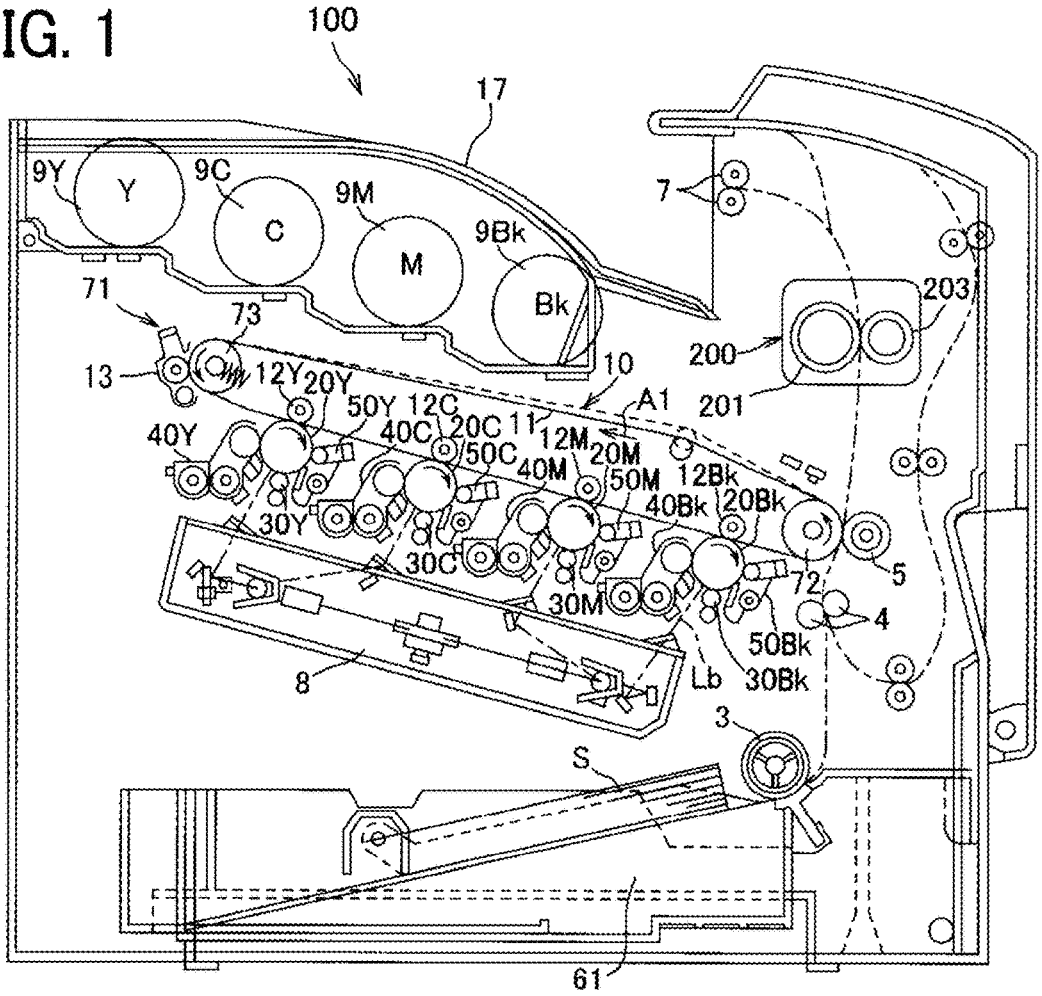
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the drawings, the following describes embodiments of the present disclosure.

Referring to FIG. 1, a description is provided of a construction of an image forming apparatus 100.

The image forming apparatus 100 illustrated in FIG. 1 is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or the like.

The image forming apparatus 100 illustrated in FIG. 1 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100 having the construction illustrated in FIG. 1, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt, that moves in a direction Al while the transfer belt 11 is disposed opposite the photoconductive drums 20Y, 20C, 20M, and 20Bk. Thereafter, the visible images formed on the transfer belt 11 are transferred collectively onto a recording sheet S (e.g., recording paper) serving as a recording medium in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk which forms a black toner image as an example, a charger 30Bk, a developing device 40Bk, a primary transfer roller 12Bk, and a cleaner 50Bk, that form the black toner image, are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. For example, the primary transfer rollers 12Y, 12C, 12M, and 12Bk disposed opposite the photoconductive drums 20Y, 20C, 20M, and 20Bk, respectively, via the transfer belt 11 apply voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from upstream to downstream in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 serves as a transferor or a transfer roller that is disposed opposite the transfer belt 11 and rotates in accordance with rotation of the transfer belt 11. The belt cleaner 13 is disposed opposite the transfer belt 11 and cleans a surface of the transfer belt 11. The optical writing device 8 serves as an optical writer disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits laser beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the laser beam Lb directed to the imaging station that forms the black toner image, the laser beams Lb are also directed to the imaging stations that form yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording sheets S to be conveyed to a secondary transfer nip formed between the secondary transfer roller 5 and the transfer belt 11. The registration roller pair 4 feeds the recording sheet S conveyed from the sheet feeder 61 toward the secondary transfer nip at a predetermined time when the yellow, cyan, magenta, and black toner images formed on the transfer belt 11 by the imaging stations, respectively, reach the secondary transfer nip. The sensor detects that a leading edge of the recording sheet S reaches the registration roller pair 4.

The image forming apparatus 100 further includes a fixing device 200, a sheet ejection roller pair 7, a sheet ejection tray 17, and toner bottles 9Y, 9C, 9M, and 9Bk. The fixing device 200 is a fuser that fixes a color toner image on the recording sheet S. The color toner image is formed by transferring the yellow, cyan, magenta, and black toner images formed on the transfer belt 11 onto the recording sheet S. The sheet ejection roller pair 7 ejects the recording sheet S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording sheets S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, a biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording sheet S. As the sheet feeding roller 3 is driven and rotated counterclockwise in FIG. 1, the sheet feeding roller 3 feeds the uppermost recording sheet S to the registration roller pair 4.

The belt cleaner 13 installed in the transfer device 71, although the belt cleaner 13 is schematically illustrated in FIG. 1, includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

The image forming apparatus 100 further includes a control panel used by a user to operate an entirety of the image forming apparatus 100 and a controller that controls the entirety of the image forming apparatus 100.

When the controller determines that the number of the recording sheets S conveyed through the fixing device 200, the operation time of the fixing device 200, the number of rotations of a fixing belt 201 of the fixing device 200, or the like reaches a predetermined value or greater, the controller controls the control panel to display a maintenance notice that instructs the user to perform maintenance of the fixing belt 201. Thus, the control panel serves as a display. For example, the controller controls the control panel to display whether or not maintenance of the fixing belt 201 is needed at a predetermined operation interval. When the controller determines that maintenance of the fixing belt 201 has been performed, the controller controls the control panel to finish displaying the maintenance notice, resuming counting the number of the recording sheets S conveyed through the fixing device 200, the operation time of the fixing device 200, the number of rotations of the fixing belt 201, and the like.

A description is provided of a construction of the fixing device 200 according to an embodiment of the present disclosure, that is incorporated in the image forming apparatus 100.

Figure 2:
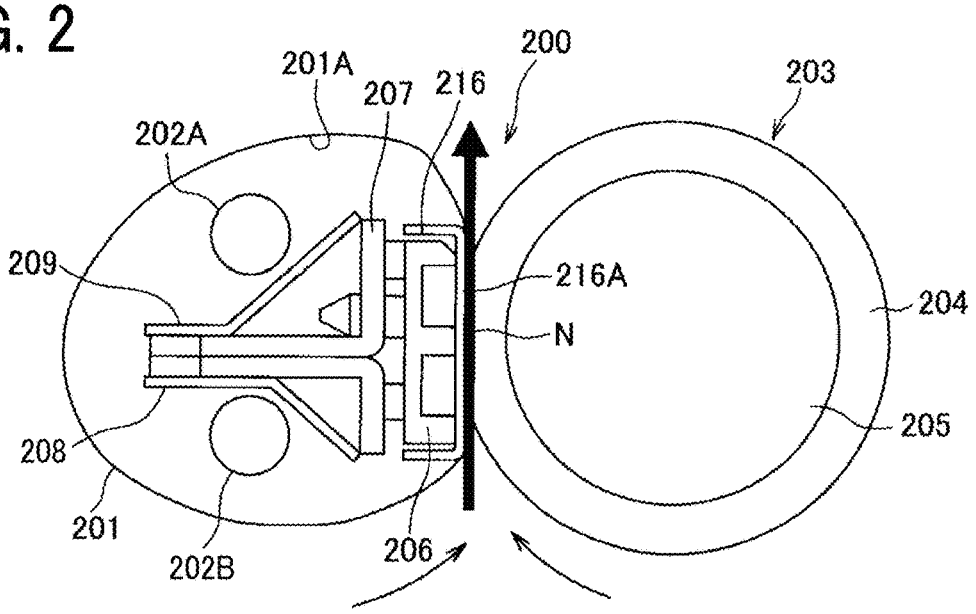
FIG. 2 is a cross-sectional view of a fixing device incorporated in the image forming apparatus depicted in FIG. 1.

As illustrated in FIG. 2, the fixing device 200 includes the fixing belt 201 serving as a fixing rotator or a fixing member, halogen heaters 202A and 202B serving as heat sources or heaters, a pressure roller 203 serving as a pressure rotator or a pressure member, and a nip former 206 (e.g., a nip forming pad).

A detailed description is now given of a construction of the fixing belt 201.

The fixing belt 201 is a tubular, endless belt or film including a base made of metal such as nickel and SUS stainless steel or resin such as polyimide, for example. The fixing belt 201 includes a release layer serving as a surface layer made of tetrafluoroethylene-perfluoroalkylvinylether copolymer (PFA), polytetrafluoroethylene (PTFE), or the like, facilitating separation of the recording sheet S from the fixing belt 201 and preventing toner from adhering to the fixing belt 201.

Optionally, an elastic layer made of silicone rubber or the like may be interposed between the base and the release layer. If the fixing belt 201 does not incorporate the elastic layer, the fixing belt 201 attains a decreased thermal capacity that improves a fixing property of being heated quickly. However, when the pressure roller 203 presses and deforms an unfixed toner image to fix the toner image on the recording sheet S, slight surface asperities of the fixing belt 201 may be transferred onto the toner image, causing a disadvantage that an orange peel mark remains on a solid part of the toner image as variation in gloss of the toner image or an orange peel image. In order to prevent this, the fixing belt 201 preferably incorporates the elastic layer having a thickness of 100 micrometers or greater. As the elastic layer deforms, the elastic layer absorbs the slight surface asperities, preventing the orange peel mark on the toner image.

The base of the fixing belt 201 includes an inner face 201A that slides over a thermal conduction aid 216. The inner face 201A may be treated with coating that decreases a coefficient of friction. In this case, considering heat resistance and abrasion resistance, a coating material such as polyimide and polyamide imide may be selected.

A detailed description is now given of a configuration of the halogen heaters 202A and 202B.

The halogen heaters 202A and 202B are disposed inside a loop formed by the fixing belt 201. The halogen heaters 202A and 202B emit light that irradiates an inner circumferential surface of the fixing belt 201, thus heating the fixing belt 201 directly. Alternatively, as a heater that heats the fixing belt 201, an induction heater (IH), a resistive heat generator, a carbon heater, or the like may be employed instead of the halogen heaters 202A and 202B. A light shield (a light shielding plate) may shield the fixing belt 201 from light emitted from the halogen heaters 202A and 202B so that the halogen heaters 202A and 202B heat the fixing belt 201 within a span corresponding to the size of the recording sheet S.

A support 207 (e.g., a stay) that supports the nip former 206 is disposed inside the loop formed by the fixing belt 201. The support 207 prevents the nip former 206 from being bent by pressure from the pressure roller 203, attaining a uniform length of a fixing nip N in a recording sheet conveyance direction in which the recording sheet S is conveyed throughout an entire length of the fixing belt 201 in an axial direction thereof.

A reflector 209 is interposed between the halogen heater 202A and the support 207. A reflector 208 is interposed between the halogen heater 202B and the support 207. The reflectors 209 and 208 reflect radiant heat and the like from the halogen heaters 202A and 202B, suppressing heating of the support 207 with radiant heat and the like and resultant waste of energy. Alternatively, instead of the reflectors 208 and 209, a surface of the support 207 may be treated with thermal insulation or mirror finish to attain similar advantages.

A detailed description is now given of a construction of the pressure roller 203.

The pressure roller 203 includes a cored bar 205, an elastic rubber layer 204, and a release layer. The elastic rubber layer 204 is disposed on an outer surface of the cored bar 205. The release layer made of PFA or PTFE is disposed on a surface of the elastic rubber layer 204. The release layer facilitates separation of the recording sheet S from the pressure roller 203. A driving force is transmitted to the pressure roller 203 from a driver such as a motor disposed in the image forming apparatus 100 depicted in FIG. 1 through a gear, thus rotating the pressure roller 203. A spring or the like presses the pressure roller 203 against the fixing belt 201. As the spring presses and deforms the elastic rubber layer 204, the pressure roller 203 forms the fixing nip N having a predetermined length in the recording sheet conveyance direction.

The pressure roller 203 may be a solid roller or a hollow roller. Alternatively, a heater such as a halogen heater may be disposed inside the pressure roller 203. The elastic rubber layer 204 may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing belt 201.

A detailed description is now given of a configuration of the nip former 206.

The nip former 206 is disposed within the loop formed by the fixing belt 201. For example, the nip former 206 is disposed opposite the pressure roller 203 via the fixing belt 201. Thus, the fixing belt 201 and the pressure roller 203 that are disposed opposite each other define the fixing nip N therebetween. As a recording sheet S bearing a toner image transferred from the transfer belt 11 is conveyed through the fixing nip N, the fixing belt 201 and the pressure roller 203 fix the toner image on the recording sheet S under heat and pressure.

The nip former 206 includes the thermal conduction aid 216. The thermal conduction aid 216 serves as a surface of the nip former 206. The inner face 201A of the fixing belt 201 slides over the thermal conduction aid 216. As illustrated in FIG. 2, the thermal conduction aid 216 is planar, defining the fixing nip N that is planar. Alternatively, the thermal conduction aid 216 may be curved or concave or may have other shapes. If the thermal conduction aid 216 is concave to define the fixing nip N that is concave, the leading edge of the recording sheet S is directed to the pressure roller 203 when the recording sheet S is ejected from the fixing nip N, facilitating separation of the recording sheet S from the fixing belt 201 and thereby preventing the recording sheet S from being jammed.

The thermal conduction aid 216 includes a face 216A, that is, a surface of the thermal conduction aid 216. The face 216A serves as a slide face over which the fixing belt 201 slides and as a nip forming face that forms the fixing nip N. A lubricant is applied between the face 216A of the thermal conduction aid 216 and the inner face 201A of the fixing belt 201 so that the lubricant decreases friction between the thermal conduction aid 216 and the fixing belt 201 and abrasion of the thermal conduction aid 216 and the fixing belt 201. Silicone oil or fluorine grease is selected as the lubricant in view of heat resistance and lubrication. The face 216A of the thermal conduction aid 216 is treated with slide coating to facilitate sliding of the fixing belt 201 over the thermal conduction aid 216. Fluorine grease having an increased viscosity is preferably used to suppress leaking of the lubricant from both lateral ends of the fixing belt 201 in the axial direction thereof to an outside of the fixing belt 201.

The thermal conduction aid 216 facilitates conduction of heat in the axial direction of the fixing belt 201 and decreases unevenness of the temperature of the fixing belt 201 in the axial direction thereof. Hence, the thermal conduction aid 216 is preferably made of a material that conducts heat in a shortened time period. For example, the thermal conduction aid 216 is preferably made of a material having an increased thermal conductivity, such as copper, aluminum, and silver. Copper is most preferable by comprehensively considering costs, availability, thermal conductivity, and processing.

The fixing belt 201 rotates in accordance with rotation of the pressure roller 203. With the construction of the fixing device 200 illustrated in FIG. 2, as the driver drives and rotates the pressure roller 203, the driving force is transmitted from the pressure roller 203 to the fixing belt 201 at the fixing nip N, rotating the fixing belt 201 in accordance with rotation of the pressure roller 203. The fixing belt 201 rotates while the nip former 206 and the pressure roller 203 sandwich the fixing belt 201 at the fixing nip N. The fixing belt 201 rotates while holders inserted into both lateral ends of the fixing belt 201 in the axial direction thereof, respectively, guide the fixing belt 201 in a circumferential span of the fixing belt 201 other than the fixing nip N. Thus, the fixing belt 201 accommodates the support 207 inside the loop formed by the fixing belt 201. The fixing belt 201 is supported by the holders such that an entirety of the fixing belt 201 is substantially tubular.

With the construction described above, the fixing device 200 attaining quick warmup is manufactured at reduced costs.

A description is provided of a construction of a comparative fixing device.

The comparative fixing device is an image heating device that includes an endless belt serving as a fixing rotator and a pressure pad serving as a nip former. A surface roughness of an inner face of the endless belt is greater than a surface roughness of a slide portion of the pressure pad, over which the endless belt slides. In the image heating device, the surface roughness of the inner face of the endless belt is greater than the surface roughness of the slide portion of the pressure pad, thus suppressing abrasion of the endless belt and the pressure pad due to sliding of the endless belt over the pressure pad.

However, if the surface roughness of the inner face of the fixing rotator (e.g., the endless belt) is merely greater than the surface roughness of a surface of the nip former (e.g., the pressure pad), the surface of the nip former is subject to abrasion. As the fixing rotator and a pressure rotator rotate, abrasion of the surface of the nip former increases. Accordingly, a slide resistance between the nip former and the fixing rotator that slides over the nip former may increase, thus increasing a torque needed to drive and rotate the fixing rotator or breaking the fixing rotator. Conversely, if the surface roughness of the inner face of the fixing rotator is merely smaller than the surface roughness of the surface of the nip former, the inner face of the fixing rotator may not retain the lubricant easily, increasing the slide resistance between the nip former and the fixing rotator.

Figure 3:
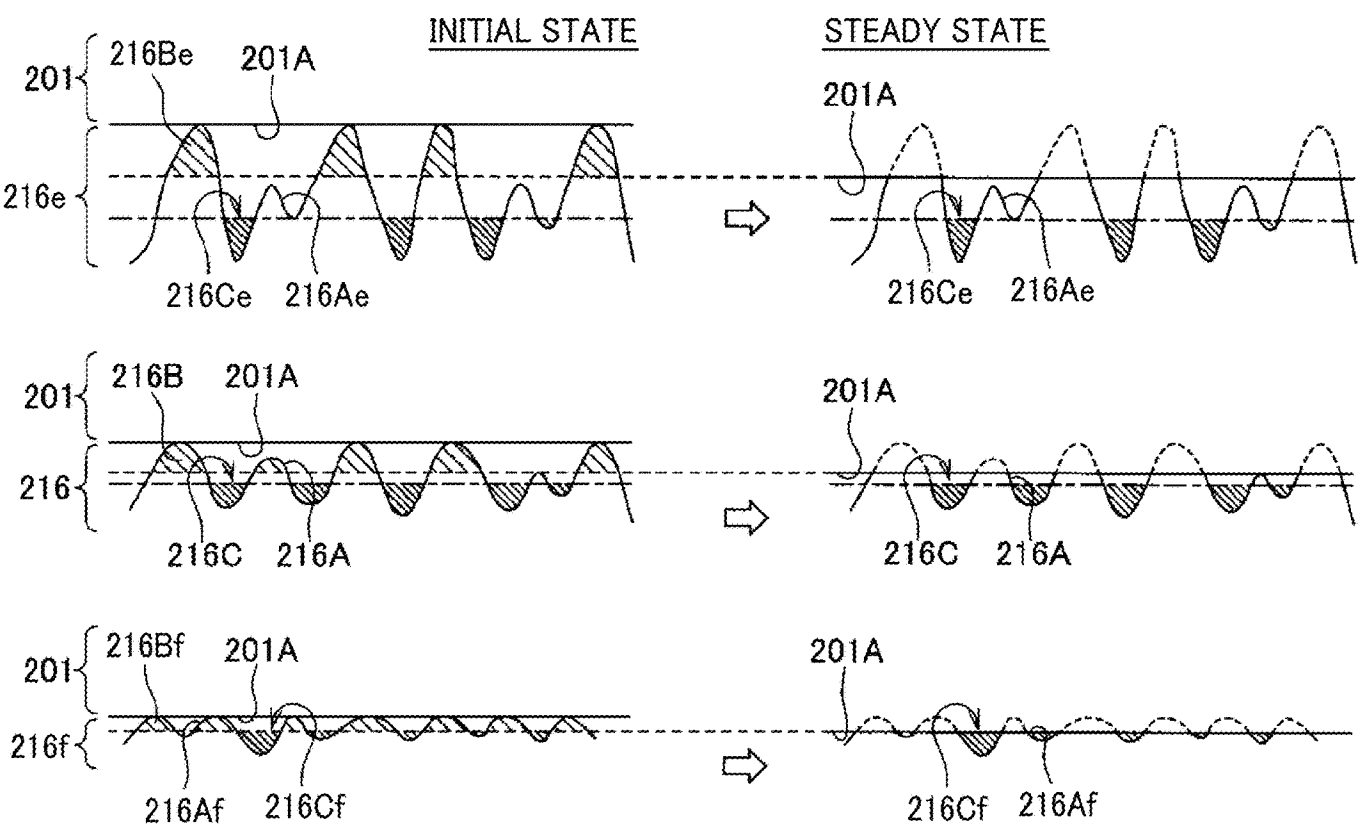
FIG. 3 is a cross-sectional view of a fixing belt and a thermal conduction aid incorporated in the fixing device depicted in FIG. 2 and thermal conduction aids incorporated in comparative fixing devices, respectively.

Referring to FIG. 3, a description is provided of a construction that retains the lubricant between the face 216A of the thermal conduction aid 216 and the inner face 201A of the fixing belt 201, which is disposed in the fixing device 200 having the construction described above.

According to an embodiment illustrated in a middle section in FIG. 3, the face 216A of the thermal conduction aid 216 has roughness. A roughness of the inner face 201A of the fixing belt 201 is smaller than a roughness of the face 216A of the thermal conduction aid 216 sufficiently. For example, the inner face 201A of the fixing belt 201 is smooth. The face 216A of the thermal conduction aid 216 includes a plurality of projections 216B (e.g., hills) and a plurality of recesses 216C (e.g., dales). The projections 216B contact the inner face 201A of the fixing belt 201. The recesses 216C retain the lubricant.

Figure 4:
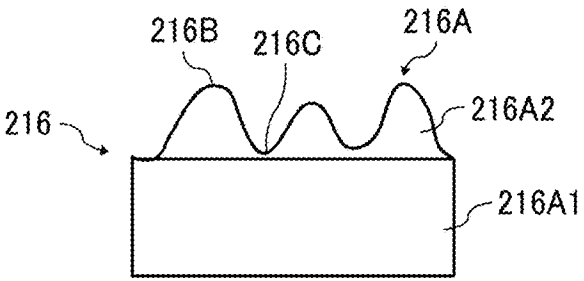
FIG. 4 is a cross-sectional view of the thermal conduction aid incorporated in the fixing device depicted in FIG. 2.

According to the embodiment illustrated in the middle section in FIG. 3, according to three-dimensional surface roughness parameters defined by the International Organization for Standardization (ISO) 25178 standard, in an initial state before the fixing belt 201 rotates, a volume of the projection 216B is smaller than 0.3 $ml/m^2$. A spatial volume of the recess 216C is greater than 0.08 $ml/m^2$. As illustrated in FIG. 4, the thermal conduction aid 216 includes a metal base 216A1 and a resin coat 216A2 mounted on the metal base 216A1. The resin coat 216A2 that constructs the face 216A of the thermal conduction aid 216 is made of resin that is more rigid than a material of the inner face 201A of the fixing belt 201.

As the fixing belt 201 rotates and slides over the thermal conduction aid 216, the fixing belt 201 scrapes the projections 216B, causing abrasion of the thermal conduction aid 216. While the fixing belt 201 rotates initially, abrasion of the thermal conduction aid 216 progresses quickly. When abrasion progresses to a certain extent, abrasion does not progress easily in a steady state. A left section in FIG. 3 illustrates the initial state. A right section in FIG. 3 illustrates the steady state.

An upper section in FIG. 3 illustrates a thermal conduction aid 216*e* according to a first comparative example. A surface roughness of the thermal conduction aid 216*e* is greater than a surface roughness of the thermal conduction aid 216 according to the embodiment of the present disclosure. For example, the thermal conduction aid 216*e* includes a face 216Ae including a projection 216Be, that is higher than the projection 216B, and a recess 216Ce, that is deeper than the recess 216C. The projection 216Be contacts the fixing belt 201 with a contact area that is smaller than a contact area with which the projection 216B contacts the fixing belt 201 and with a contact pressure that is greater than a contact pressure with which the projection 216B contacts the fixing belt 201. Hence, the projection 216Be is susceptible to abrasion more than the projection 216B. As the fixing belt 201 scrapes the projection 216Be, the projection 216Be contacts the fixing belt 201 with an increased contact area in the steady state. Accordingly, the thermal conduction aid 216*e* according to the first comparative example that has an increased surface roughness suffers from an increased abrasion amount before the steady state, generating an increased amount of abrasion powder.

A lower section in FIG. 3 illustrates a thermal conduction aid 216*f* according to a second comparative example. A surface roughness of the thermal conduction aid 216*f* is smaller than the surface roughness of the thermal conduction aid 216 according to the embodiment of the present disclosure. For example, the thermal conduction aid 216*f* includes a face 216Af including a projection 216Bf, that is lower than the projection 216B, and a recess 216Cf, that is shallower than the recess 216C. The face 216Af retains a decreased amount of the lubricant in the initial state. Additionally, in the steady state, the fixing belt 201 scrapes the projection 216Bf, causing the recess 216Cf to be even shallower. Hence, the face 216Af may retain a decreased amount of the lubricant. Accordingly, a gap between the inner face 201A of the fixing belt 201 and the face 216Af of the thermal conduction aid 216*f* may suffer from shortage of the lubricant, increasing a coefficient of friction between the fixing belt 201 and the thermal conduction aid 216*f* and causing abrasion of the fixing belt 201 and the thermal conduction aid 216*f* easily.

As parameters indicating the surface roughness, an arithmetic average roughness Ra and a maximum height roughness Rz are used. However, the arithmetic average roughness Ra represents an average of roughnesses and the maximum height roughness Rz represents a sum of a maximum peak height and a maximum valley depth. Hence, even if the arithmetic average roughness Ra and the maximum height roughness Rz are identical, the number of projections and recesses may be different.

Figure 5:
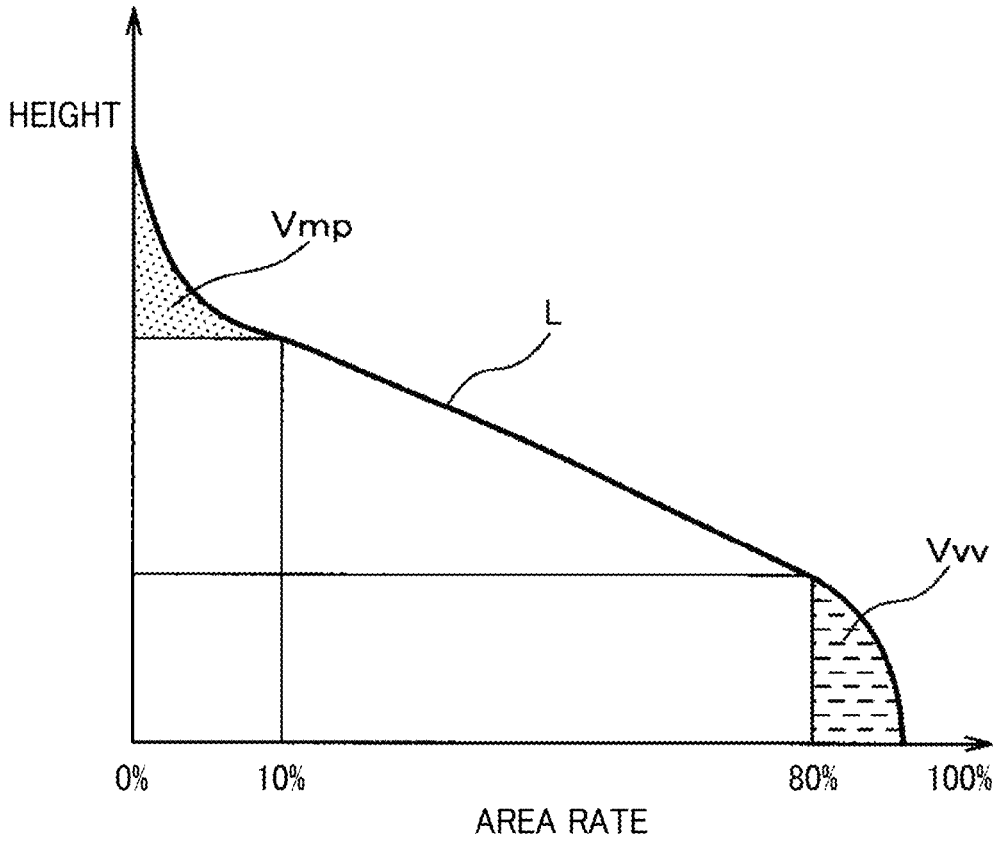
FIG. 5 is a graph illustrating a definition of a volume of a projection and a spatial volume of a recess of the thermal conduction aid depicted in FIG. 4.

To address this circumstance, as parameters to manage the surface roughness, the fixing device 200 according to the embodiments of the present disclosure employs a volume Vmp (e.g., a peak material volume) of the projection 216B and a spatial volume Vvv (e.g., a void volume of valleys) of the recess 216C, that are defined by the ISO 25178 standard. The volume Vmp and the spatial volume Vvv are volume parameters defined in a graph in FIG. 5. A load curve L illustrated in FIG. 5 is a curve indicating a height at which a load area rate is in a range of from 0% to 100%. The load area rate defines an area of a region having a predetermined height or higher.

According to the embodiments of the present disclosure, a region having a load area rate of 10% or smaller defines the volume Vmp of the projection 216B. A region having a load area rate of 80% or greater defines the spatial volume Vvv of the recess 216C.

The thermal conduction aid 216 according to the embodiments of the present disclosure that is configured as described above achieves advantages below. For example, the projection 216B in the initial state has the volume smaller than 0.3 ml/m$^2$. Accordingly, as the inner face 201A of the fixing belt 201 slides over and scrapes the projection 216B, the projection 216B transits to the steady state relatively quickly, suppressing abrasion. Additionally, the recess 216C has the spatial volume greater than 0.08 ml/m$^2$. Accordingly, even if the projection 216B suffers from abrasion and transits to the steady state, the recess 216C retains the lubricant readily.

The face 216A including the resin coat 216A2 includes the projection 216B and the recess 216C configured as described above. The face 216A is roughened readily and the volume Vmp and the spatial volume Vvv of the face 216A are managed readily.

The face 216A of the thermal conduction aid 216 is made of resin that is more rigid than the material of the inner face 201A of the fixing belt 201. The inner face 201A of the fixing belt 201 slides over the face 216A of the thermal conduction aid 216 in a state in which a sliding portion of the inner face 201A of the fixing belt 201, that slides over the face 216A of the thermal conduction aid 216, changes constantly as the fixing belt 201 rotates. Conversely, an identical portion of the face 216A of the thermal conduction aid 216 constantly contacts the fixing belt 201 which slides over the face 216A of the thermal conduction aid 216, causing the face 216A of the thermal conduction aid 216 to be subject to abrasion. To address this circumstance, the face 216A of the thermal conduction aid 216 is made of resin which is rigid, suppressing abrasion of the thermal conduction aid 216 and extending a life of the thermal conduction aid 216.

Since the face 216A of the thermal conduction aid 216 is made of resin that is more rigid than the material of the inner face 201A of the fixing belt 201, the face 216A of the thermal conduction aid 216 does not suffer from abrasion relatively easily. Accordingly, the face 216A of the thermal conduction aid 216 includes the projection 216B and the recess 216C that adjust the surface roughness of the face 216A, retaining the shape of the surface of the thermal conduction aid 216 readily. The projection 216B in the initial state has the volume smaller than 0.3 ml/m$^2$, reducing an impact imposed on the inner face 201A of the fixing belt 201, that is relatively soft, by the projection 216B that strikes the inner face 201A of the fixing belt 201.

A combination of the face 216A of the thermal conduction aid 216, that adjusts the surface roughness of the thermal conduction aid 216, and the inner face 201A of the fixing belt 201, that is relatively smooth, allows the face 216A of the thermal conduction aid 216 to retain the lubricant and allows the inner face 201A of the fixing belt 201 to decrease the coefficient of friction between the face 216A of the thermal conduction aid 216 and the inner face 201A of the fixing belt 201, that slides over the face 216A of the thermal conduction aid 216. Thus, two faces that slide over each other, that is, the inner face 201A of the fixing belt 201 and the face 216A of the thermal conduction aid 216, have different functions, respectively. Accordingly, compared to a configuration in which one of the two faces has a plurality of functions, the inner face 201A of the fixing belt 201 and the face 216A of the thermal conduction aid 216 suppress abrasion of the fixing belt 201 and the thermal conduction aid 216.

The technology of the present disclosure is not limited to the embodiments described above. The technology of the present disclosure encompasses other constructions, configurations, and the like that achieve objectives of the present disclosure. For example, the technology of the present disclosure encompasses modifications and the like described below.

For example, according to the embodiments described above, the face 216A of the thermal conduction aid 216 is made of resin that is more rigid than the material of the inner face 201A of the fixing belt 201. The materials of the face 216A of the thermal conduction aid 216 and the inner face 201A of the fixing belt 201 are selected properly in view of costs and processing. The material of the face 216A of the thermal conduction aid 216 may be as rigid as or softer than the material of the inner face 201A of the fixing belt 201.

According to the embodiments described above, the face 216A of the thermal conduction aid 216 is roughened and the inner face 201A of the fixing belt 201 is smooth. Alternatively, each of two faces that slide over each other may be roughened to retain the lubricant.

Figure 6:
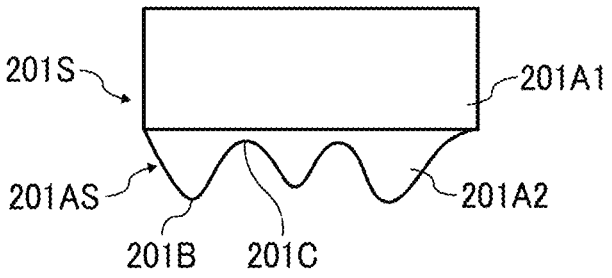
FIG. 6 is a cross-sectional view of the fixing belt depicted in FIG. 3.

Yet alternatively, a surface of a nip former (e.g., the nip former 206) may be smooth and an inner face of a fixing rotator (e.g., the fixing belt 201) may be roughened so that a projection 201B in the initial state has a volume smaller than 0.3 ml/m$^2$ and a recess 201C has a spatial volume greater than 0.08 ml/m$^2$ as illustrated in FIG. 6. For example, as illustrated in FIG. 6, a fixing belt 201S includes a metal base 201A1 and a resin coat 201A2 mounted on the metal base 201A1. The resin coat 201A2 constructs an inner face 201AS of the fixing belt 201S.

According to the embodiments described above, as illustrated in FIG. 4, the face 216A of the thermal conduction aid 216 is roughened with the resin coat 216A2. Alternatively, the face 216A of the thermal conduction aid 216 may be roughened with a metal coat.

The face 216A of the thermal conduction aid 216 may be treated with secondary processing such as buffing and pressing, for example, to eliminate a peak of the projection 216B, thus decreasing the volume Vmp of the projection 216B while suppressing change in the spatial volume Vvv of the recess 216C. Accordingly, while the spatial volume Vvv is ensured to cause the recess 216C to retain the lubricant readily, an impact imposed on the inner face 201A of the fixing belt 201 by the projection 216B decreases, extending a life of the fixing belt 201.

The thermal conduction aid 216 may include a metal surface treated with processing such as pressing and cutting to produce a lubricant storage (e.g., a recess) that retains the lubricant. Thereafter, the metal surface of the thermal conduction aid 216 is treated with fluorine coating that facilitates sliding of the fixing belt 201 and diamond-like carbon (DLC) coating that is resistant against friction, thus producing the face 216A. According to the methods described above, while the spatial volume Vvv is ensured to cause the recess 216C to retain the lubricant readily, the volume Vmp of the projection 216B decreases to reduce an impact imposed on the inner face 201A of the fixing belt 201 by the projection 216B, extending the life of the fixing belt 201.

The above describes the constructions, the configurations, the methods, and the like to attain the technology of the present disclosure. However, the technology of the present disclosure is not limited to the constructions, the configurations, the methods, and the like described above. For example, the technology of the present disclosure is described with reference to the drawings for particular embodiments mainly. However, the embodiments described above may be modified variously by those skilled in art within the scope of concepts and objectives of the technology of the present disclosure.

Accordingly, the above descriptions defining the shape, the material, and the like are examples that facilitate understanding of the technology of the present disclosure and do not limit the scope of the technology of the present disclosure. Hence, the technology of the present disclosure also encompasses components with names not using a part or an entirety of limitations of the shape, the material, and the like.

A description is provided of an embodiment of the present disclosure.

Figure 7:
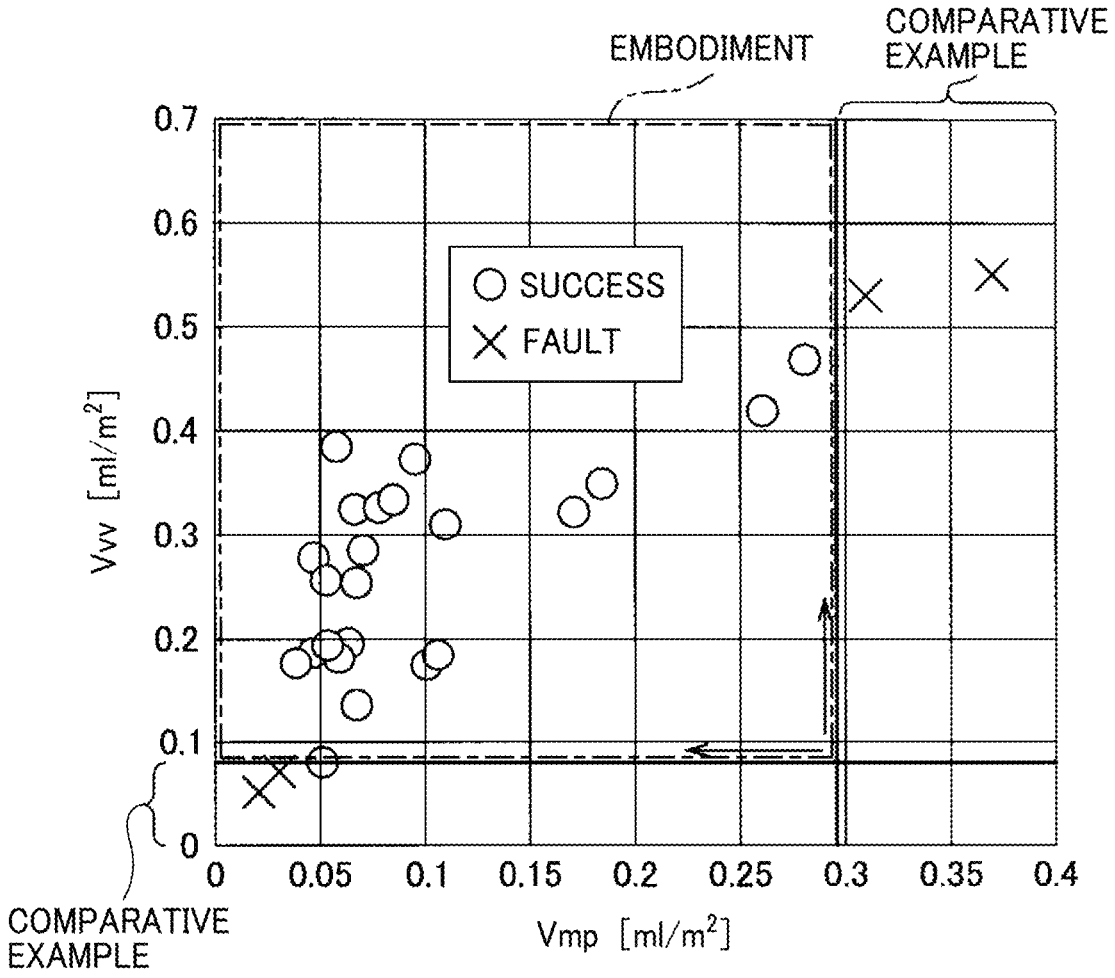
FIG. 7 is a graph illustrating results of a test comparing an embodiment of the fixing device depicted in FIG. 2 and comparative examples.

An endurance test was performed with the fixing device 200 by changing the volume Vmp of the projection 216B and the spatial volume Vvv of the recess 216C of the face 216A of the thermal conduction aid 216. FIG. 7 illustrates results of the endurance test. The volume Vmp and the spatial volume Vvv are values in the initial state.

In the endurance test, after the fixing device 200 was operated to convey sheets in the number under product warranty, a unit driving torque of the fixing device 200 was measured. If the unit driving torque was a predetermined value or smaller, the unit driving torque was marked with circles as success data in FIG. 7. If the unit driving torque was greater than the predetermined value, the unit driving torque was marked with crosses as fault data in FIG. 7.

The volume Vmp of the projection 216B and the spatial volume Vvv of the recess 216C were observed with the laser scanning confocal microscope VK-X100 for shape analysis of 200 magnifications, that was available from Keyence Corporation. The load curve of a face was calculated from a measurement area having a length of 1 mm and a width of 1 mm with a Gaussian filter, tilt correction, and an S-filter of 2 μm.

In the embodiment having a range in which the volume Vmp of the projection 216B was smaller than 0.3 ml/m$^2$ and the spatial volume Vvv of the recess 216C was greater than 0.08 ml/m$^2$, all the unit driving torques were the predetermined value or smaller. Conversely, in comparative examples having ranges that were outside the above-described range, respectively, all the unit driving torques were greater than the predetermined value.

A description is provided of advantages of a fixing device (e.g., the fixing device 200).

As illustrated in FIG. 2, the fixing device includes a fixing rotator (e.g., the fixing belts 201 and 201S), a pressure rotator (e.g., the pressure roller 203), and a nip former (e.g., the nip former 206).

The fixing rotator is tubular and rotatable. The pressure rotator is disposed opposite the fixing rotator and is rotatable. The nip former sandwiches the fixing rotator together with the pressure rotator to form a nip (e.g., the fixing nip N) between the fixing rotator and the pressure rotator. A lubricant is applied between an inner face (e.g., the inner faces 201A and 201AS) of the fixing rotator and an outer face (e.g., the face 216A) of the nip former, that is disposed opposite the inner face of the fixing rotator. Thus, the inner face of the fixing rotator and the outer face of the nip former sandwich the lubricant. As illustrated in FIGS. 4 and 6, at least one of the inner face of the fixing rotator and the outer face of the nip former includes a projection (e.g., the projections 201B and 216B) and a recess (e.g., the recesses 201C and 216C). As three-dimensional surface roughness parameters defined by the ISO 25178 standard, in an initial state before the fixing rotator rotates, the projection has a volume smaller than 0.3 ml/m$^2$ and the recess has a spatial volume greater than 0.08 ml/m$^2$.

In the fixing device according to the embodiments of the present disclosure, the projection has the volume smaller than 0.3 ml/m$^2$ in the initial state. Hence, as the inner face of the fixing rotator slides over the outer face of the nip former and the projection of the fixing rotator or the nip former is scraped, the projection transits relatively quickly to a steady state in which abrasion does not progress, thus suppressing abrasion of the fixing rotator and the nip former.

Additionally, the recess has the spatial volume greater than 0.08 ml/m$^2$. Accordingly, even if the projection suffers from abrasion and transits to the steady state, the recess retains the lubricant readily.

According to the embodiments described above, the fixing belt 201 serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator that is tubular and configured to rotate, the fixing rotator including an inner face;

a pressure rotator disposed opposite the fixing rotator and configured to rotate; and a nip former configured to sandwich the fixing rotator together with the pressure rotator to form a nip between the fixing rotator and the pressure rotator, the nip former including an outer face disposed opposite the inner face of the fixing rotator, the inner face of the fixing rotator and the outer face of the nip former configured to sandwich a lubricant, at least one of the inner face of the fixing rotator and the outer face of the nip former including:

a projection having a volume smaller than 0.3 ml/m$^2$; and a recess having a spatial volume greater than 0.08 ml/m$^2$, the volume and the spatial volume being three-dimensional surface roughness parameters, respectively, defined by the International Organization for Standardization 25178 standard in an initial state before the fixing rotator rotates.

2. The fixing device according to claim 1, wherein the at least one of the inner face of the fixing rotator and the outer face of the nip former further includes:

a metal base; and a resin coat mounted on the metal base.

3. The fixing device according to claim 2, wherein the resin coat of the projection has the volume smaller than 0.3 ml/m$^2$ and the resin coat of the recess has the spatial volume greater than 0.08 ml/m$^2$ in the initial state.

4. The fixing device according to claim 1, wherein the projection of the outer face of the nip former has the volume smaller than 0.3 ml/m$^2$ and the recess of the outer face of the nip former has the spatial volume greater than 0.08 ml/m$^2$ in the initial state, and wherein a surface roughness of the outer face of the nip former is greater than a surface roughness of the inner face of the fixing rotator.

5. The fixing device according to claim 4, wherein the outer face of the nip former is made of a material that is more rigid than a material of the inner face of the fixing rotator.

6. The fixing device according to claim 1, wherein the projection of the nip former is configured to contact the inner face of the fixing rotator, and wherein the recess of the nip former is configured to retain the lubricant.

7. The fixing device according to claim 6, wherein the fixing rotator is configured to slide over and scrape the projection of the nip former as the fixing rotator rotates.

8. The fixing device according to claim 7, wherein the nip former further includes a thermal conduction aid over which the inner face of the fixing rotator slides.

9. The fixing device according to claim 1, wherein the fixing rotator includes a fixing belt.

10. An image forming apparatus comprising:

an image bearer configured to bear an image; and a fixing device configured to fix the image on a recording medium, the fixing device including:

a fixing rotator that is tubular and configured to rotate, the fixing rotator including an inner face;

a pressure rotator disposed opposite the fixing rotator and configured to rotate; and a nip former configured to sandwich the fixing rotator together with the pressure rotator to form a nip between the fixing rotator and the pressure rotator, the nip former including an outer face disposed opposite the inner face of the fixing rotator, the inner face of the fixing rotator and the outer face of the nip former configured to sandwich a lubricant, at least one of the inner face of the fixing rotator and the outer face of the nip former including:

a projection having a volume smaller than 0.3 ml/m$^2$; and a recess having a spatial volume greater than 0.08 ml/m$^2$, the volume and the spatial volume being three-dimensional surface roughness parameters, respectively, defined by the International Organization for Standardization 25178 standard in an initial state before the fixing rotator rotates.

* * * * *